US007293651B2

(12) United States Patent
Lee et al.

(10) Patent No.: US 7,293,651 B2
(45) Date of Patent: Nov. 13, 2007

(54) DUAL WINDOW DISPLAY PACKAGING APPARATUS AND METHOD

(75) Inventors: Kendrew Lee, Fremont, CA (US); Noel Lee, Las Vegas, NV (US)

(73) Assignee: Monster Cable Products, Inc., Brisbane, CA (US)

( * ) Notice: Subject to any disclaimer, the term of this patent is extended or adjusted under 35 U.S.C. 154(b) by 257 days.

(21) Appl. No.: 11/027,013

(22) Filed: Dec. 30, 2004

(65) Prior Publication Data

US 2006/0144740 A1 Jul. 6, 2006

(51) Int. Cl.
*B65D 73/00* (2006.01)

(52) U.S. Cl. ..... 206/463; 206/471; 206/461

(58) Field of Classification Search ..... 206/461–465, 206/467, 469, 471, 806
See application file for complete search history.

(56) References Cited

U.S. PATENT DOCUMENTS 4,016,972 A * 4/1977 Szamborski ..... 206/6.1
4,742,912 A * 5/1988 Lee ..... 206/459.5
4,804,984 A * 2/1989 Heuer et al. ..... 206/316.2
5,875,893 A * 3/1999 Lee et al. ..... 206/463
6,170,663 B1 * 1/2001 Glassman ..... 206/461
6,276,529 B1 * 8/2001 Feehan, Jr. ..... 206/469
6,345,716 B1 * 2/2002 Chapman ..... 206/471
7,066,327 B2 * 6/2006 Baublitz et al. ..... 206/349
2005/0133398 A1 * 6/2005 Schwester ..... 206/461

* cited by examiner

*Primary Examiner*—Mickey Yu
*Assistant Examiner*—Steven A. Reynolds
(74) *Attorney, Agent, or Firm*—LaRiviere, Grubman & Payne, LLP

(57) ABSTRACT

An apparatus (100) and a method (M) for packaging, displaying, and storing an electronic product having a front portion (10) including a complementary contour (11), a back portion (30) including a complementary contour (31), and an inner portion (20) including a complementary contour (21), the inner portion (20) being disposed between the front portion (11) and the back portion (30), and the front portion (10), the back portion (30), and the inner portion (20) being fitted together via their respective complementary contours (11, 31, 21).

14 Claims, 6 Drawing Sheets

DUAL WINDOW DISPLAY PACKAGING APPARATUS AND METHOD

CROSS-REFERENCE TO RELATED APPLICATION

This application is a nonprovisional utility patent application which relates to a concurrently filed U.S. design patent application, Attorney Docket No. P1667, entitled Professional Audio Interconnect Packaging."

TECHNICAL FIELD

The present invention relates to packaging apparatuses and methods. More particularly, the present invention relates to packaging apparatuses and methods for electronic products. Even more particularly, the present invention relates to packaging apparatuses and methods for both consumer and professional electronic products.

BACKGROUND ART

The currently existing art involves several apparatuses and methods for packaging electronic products. Currently, electronic products are typically sold in a hard plastic packaging, wherein a front portion and a rear portion has been heat-seamed together. With respect to these current art hard plastic packages, the consumer must cut through the hard plastic using heavy shears in order to access the electronic product, risking personal injury from the newly cut packaging edges. Because the current art plastic packaging is typically heavy gauge, substantial internal stresses will develop in the package during the consumer's attempt to remove the product. During such attempted removal, the sharp edges of a cut packaging may, and often do, spring-back on the consumer, thereby causing personal injury. In addition, the current art hard plastic packaging, once cut, cannot readily restore the product. The consumer must find other means for storing the product. When the product is an audio interconnect, safe and convenient storage is of utmost concern. Thus, a long-felt need is seen to exist for an apparatus and a method which provides such safe and convenient packaging and storage for electronic products.

DISCLOSURE OF THE INVENTION

Accordingly, the present invention addresses this long-felt need for a safe and convenient consumer and professional electronic products packaging apparatus and method. The present invention involves an apparatus for packaging, displaying, and storing a product, especially an electronic product, generally comprising a front portion including a complementary contour, a back portion including a complementary contour, and an inner portion including a complementary contour, the inner portion being disposed between the front portion and the back portion, and the front portion, back portion, and inner portion being fitted together via their respective complementary contours. The present invention also involves a corresponding method of manufacturing the present apparatus, generally comprising the steps of providing a front portion including a complementary contour, providing a back portion including a complementary contour, and providing an inner portion including a complementary contour, the inner portion being disposed between the front portion and the back portion, and the front portion, back portion, and inner portion being fitted together via their respective complementary contours.

In the preferred embodiment of the present invention, the inner portion complementary contour accommodates the product and comprises a feature such as a structure for retaining the product and dual windows for displaying the product. The retaining structure comprises at least one orifice through which the product is disposed. The orifice comprises a geometric shape; and the geometric shape comprises at least one digit, whereby the at least one digit forms a "valve" for facilitating retention of the product. Preferably, the at least one digit comprises five digits, whereby the five digits form a pentagram configuration. The product comprises an audio interconnect cable, having at least one connector correspondingly disposed on at least one end of the cable, wherein the at least one connector is threaded through the valve (i.e., open position), and whereby the cable is retained by the digits of the valve as the connector has an outer dimension being generally greater than the inner dimension of the valve in its "closed" position.

Some advantages of the present invention include, but are not limited to, the easy opening of the packaging apparatus, thereby eliminating the related art need for scissors to cut through the typically thick polymer packaging in order to access the product, and reducing the chance of injury to the consumer by eliminating the sharp edges arising from cutting related art packages. Other advantages include the stable retention of the product in the package, during display as well as after opening and during storage, high visibility of the product on display and in storage, and efficient coiling of the product on display and in storage. Other features of the present invention are disclosed, or are apparent in the section entitled "Detailed Description of the Invention."

BRIEF DESCRIPTION OF THE DRAWING

For a better understanding of the present invention, reference is made to the below-referenced accompanying Drawing. Reference numbers refer to the same or equivalent parts of the present invention throughout the several figures of the Drawing.

MODES FOR CARRYING OUT THE INVENTION

Figure 1:
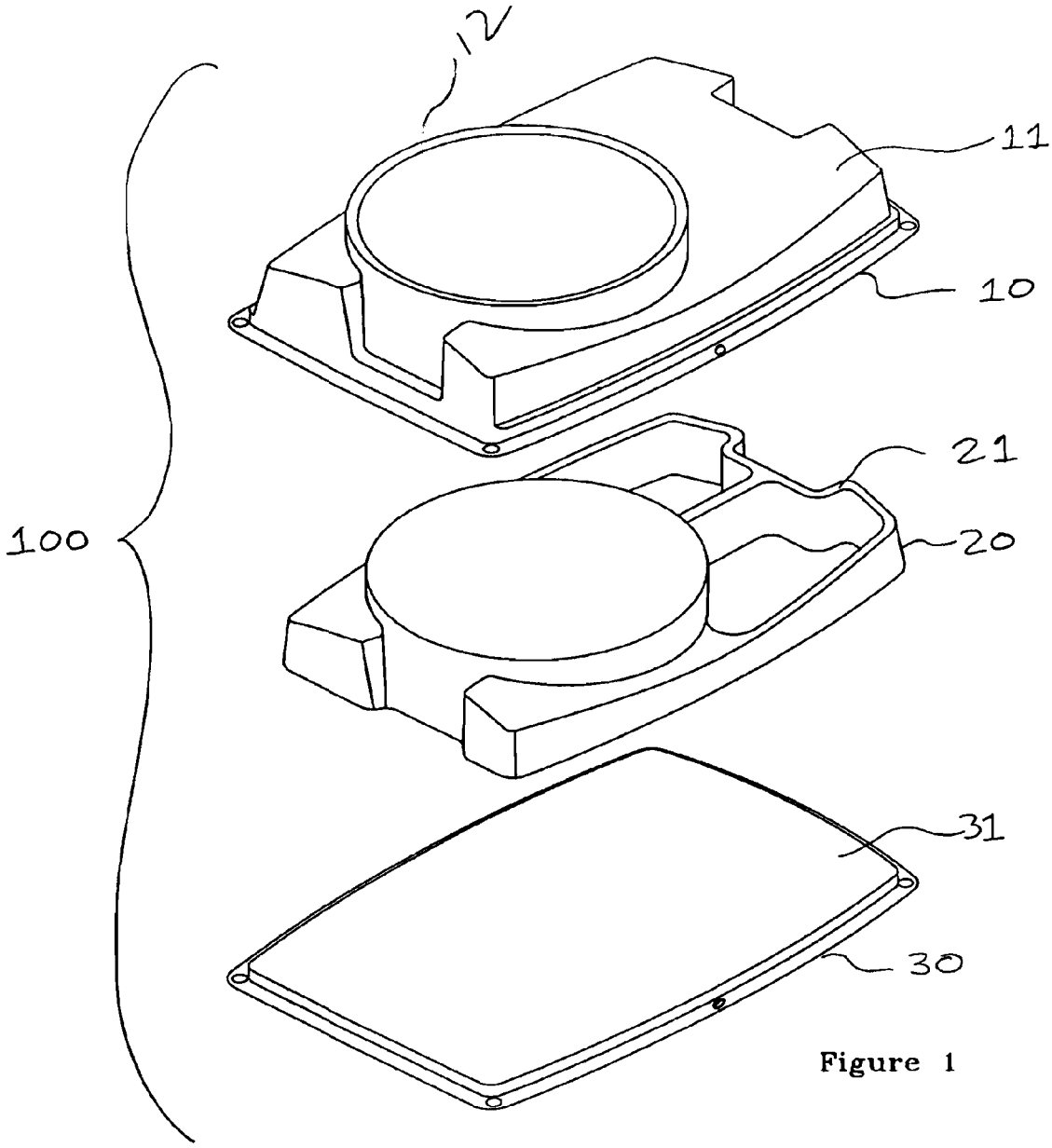
FIG. 1 is an exploded perspective view of a dual window packaging apparatus, in accordance with the present invention.

FIG. 1 illustrates, in an exploded perspective view, a dual window packaging apparatus 100, in accordance with the present invention. The apparatus 100 comprises a front portion 10 including a complementary contour 11, a back portion 30 including a complementary contour 31, and an inner portion 20 including a complementary contour 21, the inner portion 20 being disposed between the front portion 10 and the back portion 30. The front portion 10, the back portion 30, and the inner portion 20 being fitted together via their respective complementary contours 11, 31, 21.

Figure 2:
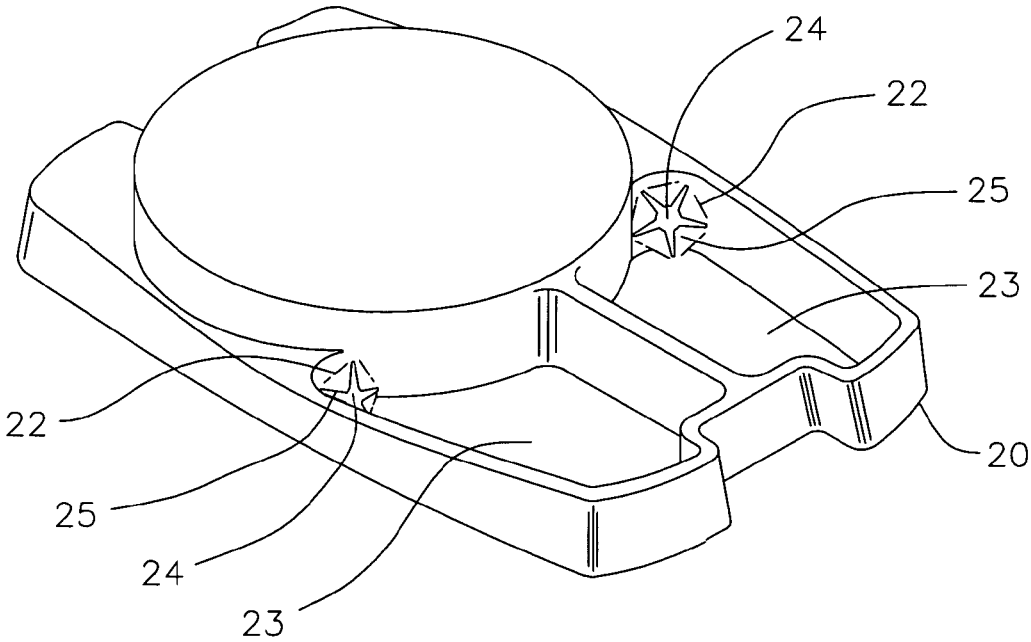
FIG. 2 is a perspective view of an inner portion of a dual window display packaging apparatus, in accordance with a preferred embodiment of the present invention.

FIG. 2 illustrates, in a perspective view, an inner portion 20 of a dual window display packaging apparatus 100, in accordance with a preferred embodiment of the present invention. The inner portion complementary contour 21 accommodates the product (not shown) and comprises at least one feature selected from a group consisting of a structure for retaining 22 the product and at least one window 23 for displaying the product. The retaining structure 22 comprises at least one orifice 24 through which the product is disposed, e.g., by threading the product through the orifice 24. The orifice 24 has a cross-section which comprises a geometric shape; and the geometric shape comprises at least one digit 25 which forms a "valve" for facilitating retention of the product. Preferably, the at least one digit 25 comprises five digits, the five digits forming a pentagram configuration in the orifice cross-section (FIG. 2). The product comprises an audio interconnect cable (not shown) having at least one connector (not shown) correspondingly disposed on at least one end of the cable, wherein the at least one connector is retained by the valve, i.e., after threading the connector end through the digits, whereupon the "valve" closes on the cable.

Figure 3:
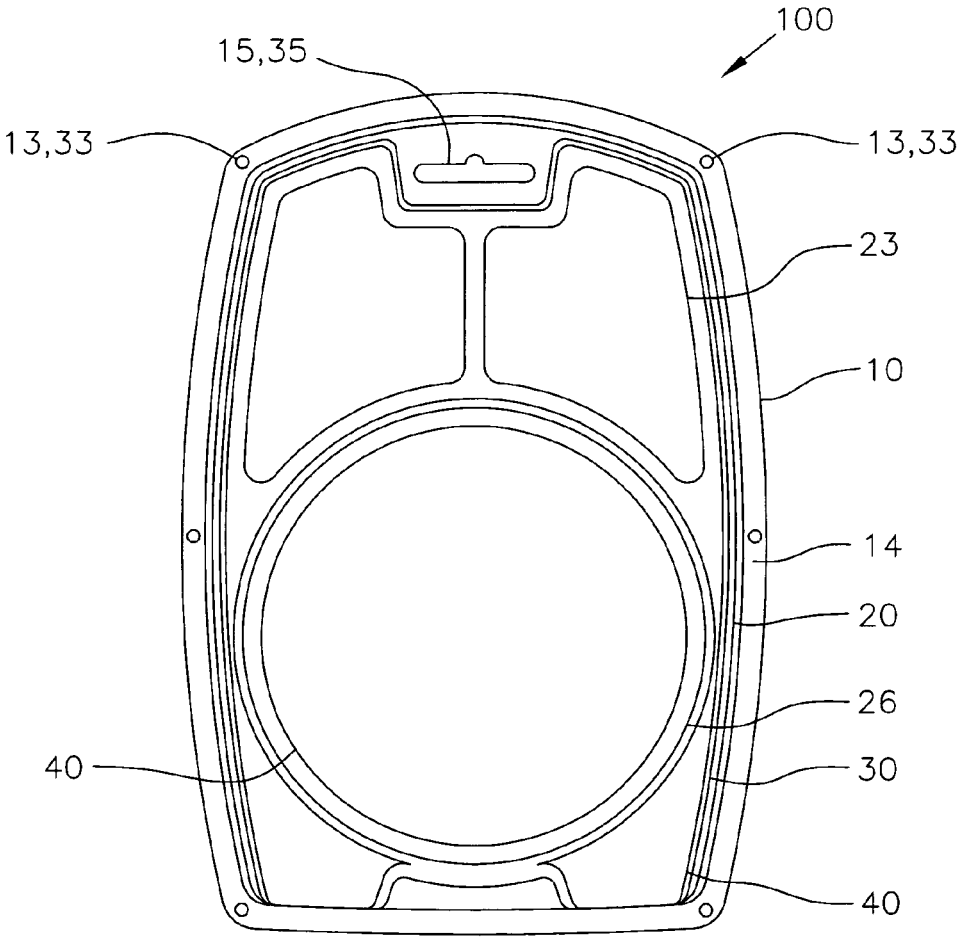
FIG. 3 is a front view of a dual window packaging apparatus, as shown in FIG. 1, in accordance with the present invention.

FIG. 3 illustrates, in a front view, a dual window packaging apparatus 100, as shown in FIG. 1, in accordance with the present invention. The inner portion complementary contour 21 comprises a rounded recess 26 for facilitating coiling of the cable (not shown), and wherein the front portion complementary contour 11 comprises a rounded recess 12 for accommodating the inner portion complementary contour rounded recess 26. The front portion 10 comprises an outer dimension; at least one coincident tap 13 distributed along a periphery 14; and a coincident orifice 15 for facilitating display of the product by hanging. The apparatus 100 further comprises a liner insert 40 being disposed between the front portion 10 and the inner portion 20 as well as between the back portion 30 and the inner portion 20, the liner insert 40 facilitating advertisement and identification of the product, wherein the front, inner, and back portions 10, 20, 30 all comprise a material having an optical property selected from a group consisting of transparency and translucency for facilitating viewing of the liner insert 40 and the product (not shown).

Figure 4:
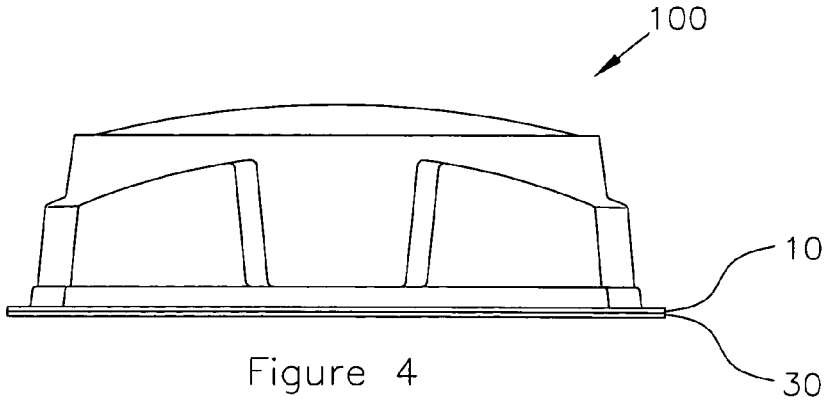
FIG. 4 is a bottom view of a dual window packaging apparatus, as shown in FIG. 1, in accordance with the present invention.

FIG. 4 illustrates, in a bottom view, a dual window packaging apparatus 100 having the front portion 10 disposed on the back portion 30, as shown in FIG. 1, in accordance with the present invention.

Figure 5:
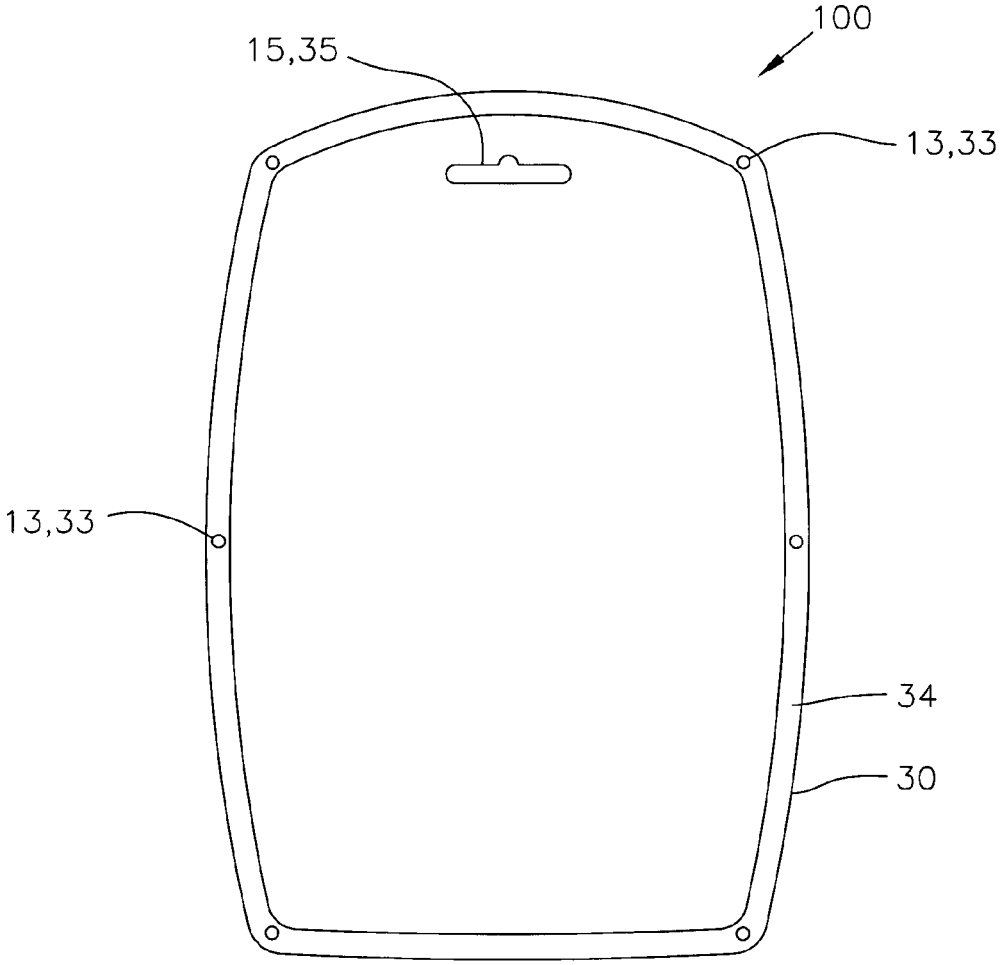
FIG. 5 is a rear view of a dual window packaging apparatus, as shown in FIG. 1, in accordance with the present invention.

FIG. 5 illustrates, in a rear view, a dual window packaging apparatus 100, as shown in FIG. 1, in accordance with the present invention. The back portion 30 comprises an outer dimension being approximately equal to that of the front portion outer dimension; at least one coincident tap 33 distributed along a periphery 34; and a coincident orifice 35 for facilitating display of the product by hanging. The inner portion 20 (not shown) has an outer dimension being less than that of both the front portion 10 (FIG. 3) and that of the back portion 30 (FIG. 4). The apparatus 100 further comprises a feature for fastening the front portion 10 to the back portion 20 (FIGS. 3 and 4). The fastening feature comprises at least one rivet (not shown) disposed through the corresponding coincident taps 13, 33 for sandwiching the inner portion 20, accommodating the product, between the front portion 10 and the back portion 30.

Figure 6:
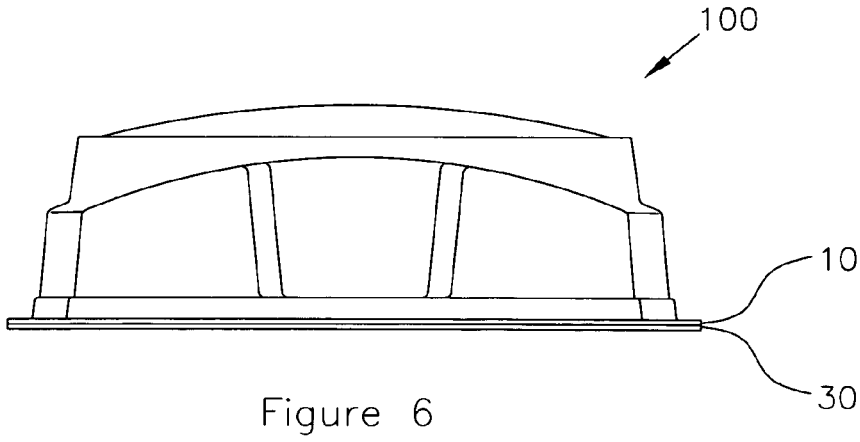
FIG. 6 is top view of a dual window packaging apparatus, as shown in FIG. 1, in accordance with the present invention.

FIG. 6 illustrates, in a top view, a dual window packaging apparatus 100 having the front portion 10 disposed on the back portion 30, as shown in FIG. 1, in accordance with the present invention.

Figure 7:
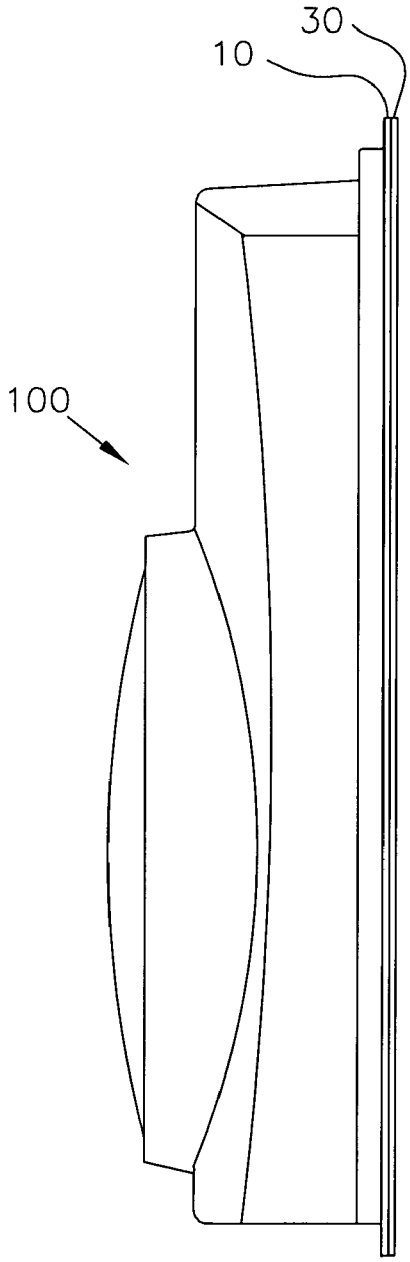
FIG. 7 is a side view of a dual window packaging apparatus, as shown in FIG. 1, in accordance with the present invention.

FIG. 7 illustrates, in a side view, a dual window packaging apparatus 100 having the front portion 10 disposed on the back portion 30, as shown in FIG. 1, in accordance with the present invention.

Figure 8:
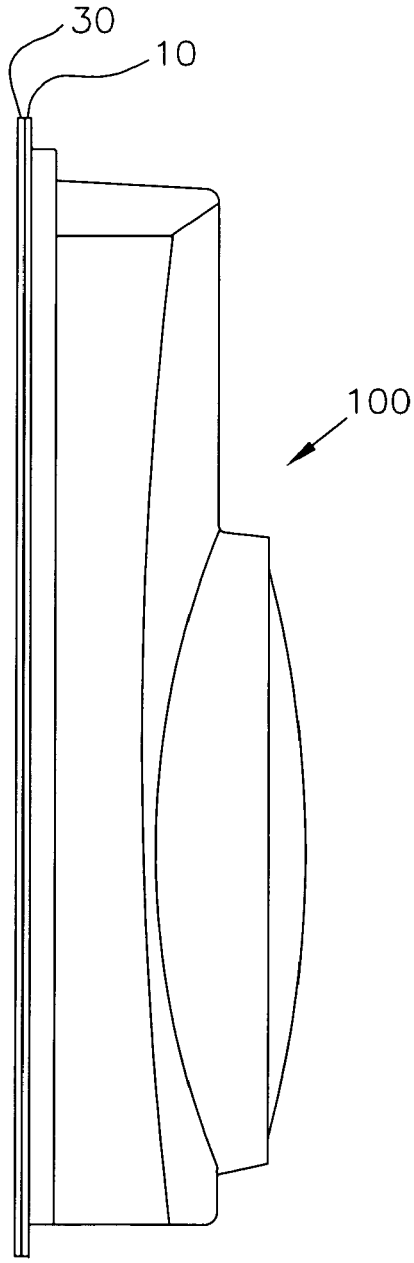
FIG. 8 is an opposing side view of a dual window packaging apparatus, as shown in FIG. 1, in accordance with the present invention.

FIG. 8 illustrates, in an opposing side view, a dual window packaging apparatus 100 having the front portion 10 disposed on the back portion 30, as shown in FIG. 1, in accordance with the present invention.

Figure 9:
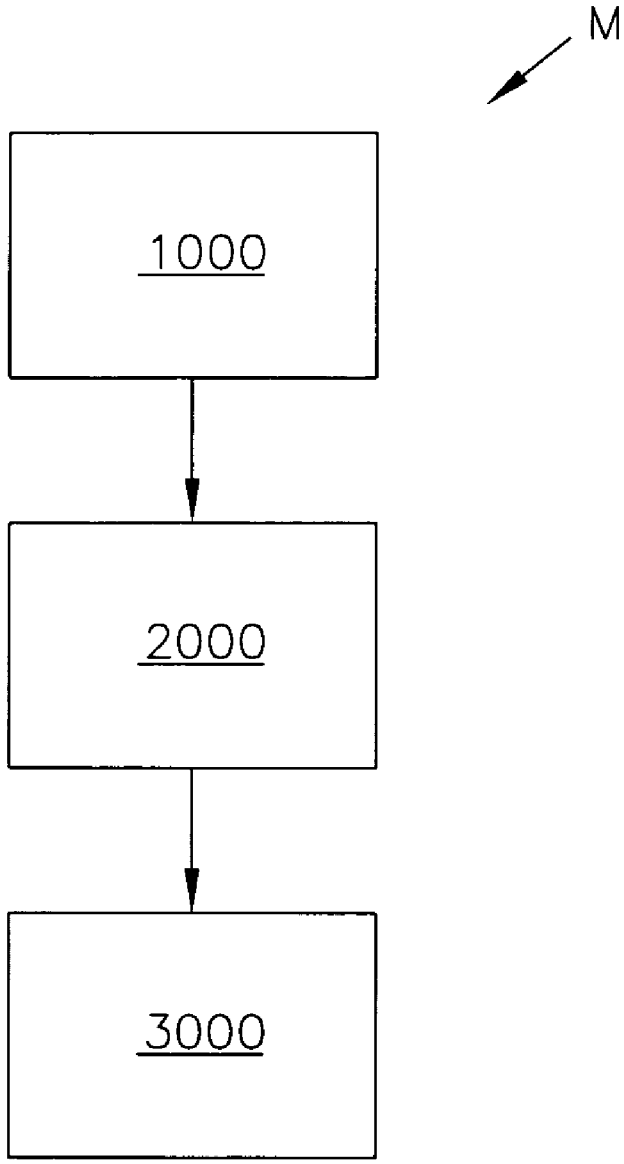
FIG. 9 is a flowchart for a general method of packaging, displaying, and storing a product, in accordance with the present invention.

FIG. 9 illustrates, in a flowchart, a method M of packaging, displaying, and storing a product, in accordance with the present invention. The method M comprises the steps of providing a front portion 10 including a complementary contour 11 (as indicated by block 1000), providing a back portion 30 including a complementary contour 31 (as indicated by block 2000), and providing an inner portion 20 including a complementary contour 21 (as indicated by block 3000), the inner portion 20 being disposed between the front portion 10 and the back portion 30, and the front portion 10, the back portion 30, and the inner portion 20 being fitted together via their respective complementary contours 11, 31, 21.

The inner portion providing step 3000 comprises accommodating the product in the inner portion complementary contour 21. The inner portion providing step 3000 comprises providing the inner portion complementary contour 21 with at least one feature selected from a group consisting of a structure for retaining 22 the product and at least one window 23 for displaying the product. The inner portion providing step 3000 comprises providing the retaining structure 22 with at least one orifice 24 through which the product is disposed, providing the at least one orifice 24 with a geometric shape, and providing the geometric shape with at least one digit 25, whereby the at least one digit 25 forms a valve for facilitating retention of the product, as described, supra, with respect to the apparatus 100. The inner portion providing step 3000 comprises forming the at least one digit 25 as five digits, whereby the five digits form a pentagram configuration. Reiterating, the product comprises an audio interconnect cable having at least one connector correspondingly disposed on at least one end of the cable, wherein the inner portion providing step comprises retaining the at least one connector by the valve.

In addition, the inner portion providing step 3000 comprises providing the inner portion complementary contour 21 with a rounded recess 26 for facilitating coiling of the cable. The front portion providing step 1000 comprises providing the front portion complementary contour 11 with a rounded recess 12 for accommodating the inner portion complementary contour rounded recess 26. The method M further comprises the step of providing a feature for fastening (not shown) the front portion 10 to the back portion 30. The front portion providing step 1000 comprises providing the front portion 10 with an outer dimension, providing at least one coincident tap 13 distributed along a periphery 14, and providing a coincident orifice 15 for facilitating display of the product by hanging.

Further, the back portion providing step 2000 comprises providing the back portion with an outer dimension being approximately equal to that of the front portion outer dimension, providing at least one coincident tap 33 distributed along a periphery 34, providing a coincident orifice 35 for facilitating display of the product by hanging. The inner portion providing step 3000 comprises providing the inner portion 20 with an outer dimension less than that of both the front portion 10 and that of the back portion 30. The fastening feature providing step (not shown) comprises providing at least one rivet (not shown) disposed through the corresponding coincident taps 13, 33 for sandwiching the inner portion 20, accommodating the product, between the front portion 10 and the back portion 30. The method M further comprises the step of providing a liner insert 40 (not shown) being disposed between the front portion 10 and the inner portion 20 as well as between the back portion 30 and the inner portion 20, the liner insert 40 facilitating advertisement and identification of the product, wherein the front, inner, and back portions 10, 20, 30 all comprise a material having an optical property such as transparency and translucency for facilitating viewing of the liner insert 40 and the product.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, various changes and modifications in form, material, and fabrication material detail maybe made without departing from the spirit and scope of the inventions as set forth in the appended claims should be readily apparent to those of ordinary skill in the art. No claim herein is to be construed under the provisions of 35 U.S.C. § 112, sixth paragraph, unless the element is expressly recited using the phrase "means for."

INDUSTRIAL APPLICABILITY

The present invention industrially applies to packaging apparatuses and methods. More particularly, the present invention industrially applies to packaging apparatuses and methods for electronic products. Even more particularly, the present invention industrially applies to packaging apparatuses and methods for both consumer and professional electronic products.

What is claimed:

1. An apparatus for packaging, displaying, and storing a product, comprising:

a front portion including a complementary contour;

a back portion including a complementary contour; and an inner portion including a complementary contour, the inner portion being disposed between the front portion and the back portion, and the front portion, the back portion and the inner portion being fitted together via their respective complementary contours;

said inner portion complementary contour accommodating the product and including at least one feature selected from a group consisting of means for retaining the product and at least one window for displaying the product;

said retaining means including at least one orifice through which the product is disposed, said orifice includes a geometric shape, said geometric shape includes at least one digit, said digit forming a valve for facilitating retention of the product; and said digit includes five digits, the five digits forming a pentagram configuration.

2. An apparatus, as recited in claim 1, the product includes an audio interconnect cable having at least one connector correspondingly disposed on at least one end of the cable, and said connector is threaded through the at least one orifice and the cable is retained by the valve.

3. An apparatus, as recited in claim 1, the inner portion complementary contour including a rounded recess for facilitating coiling of the cable, and the front portion complementary contour including a rounded recess for accommodating the inner portion complementary contour rounded recess.

4. An apparatus, as recited in claim 1, further including means for fastening the front portion to the back portion.

5. An apparatus, as recited in claim 4, the front portion includes:

an outer dimension;

at least one coincident tap distributed along the periphery; and a coincident orifice for facilitating display of the product by hanging, the back portion includes:

an outer dimension being approximately equal to that of the front portion outer dimension;

at least one coincident tap distributed along a periphery; and a coincident orifice for facilitating display of the product by hanging, the inner portion has an outer dimension being less than that of both the front portion and that of the back portion, and the fastening means includes at least one rivet disposed through the corresponding coincident taps for sandwiching the inner portion, accommodating the product, between the front portion and the back portion.

6. An apparatus, as recited in claim 1, a liner insert being disposed between the front portion and the inner portion as well as between the back portion and the inner portion, the liner insert facilitating advertisement and identification of the product, the front, inner, and back portions all including a material having an optical property selected from a group consisting of transparency and translucency for facilitating viewing of the liner insert and the product.

7. An apparatus for packaging, displaying, dispensing, and storing a product, comprising:

a front portion including a complementary contour;

a back portion including a complementary contour; and an inner portion including a complementary contour, the inner portion being disposed between the front portion and the back portion, and the front portion, the back portion, and the inner portion being fitted together via their respective complementary contours, the inner portion complementary contour accommodates the product and includes at least one feature selected from a group consisting of means for retaining the product and at least one window for displaying the product, the retaining means includes at least one orifice through which the product is disposed, the at least one orifice includes a geometric shape, the geometric shape includes at least one digit, the at least one digit forming a valve for facilitating retention of the product, the at least one digit includes five digits, the five digits forming a pentagram configuration, the product includes an audio interconnect cable having at least one connector correspondingly disposed on at least one end of the cable, the at least one connector is threaded through the at least one orifice and the cable is retained by the valve, the inner portion complementary contour includes a rounded recess for facilitating coiling of the cable, and the front portion complementary contour includes a rounded recess for accommodating the inner portion complementary contour rounded recess.

8. A method of packaging, displaying, and storing a product, comprising the steps of:

providing a front portion including a complementary contour;

providing a back portion including a complementary contour; and providing an inner portion including a complementary contour, the inner portion being disposed between the front portion and the back portion, and the front portion the back portion, and the inner portion being fitted together via their respective complementary contours;

the inner portion providing step includes accommodating the product in the inner portion complementary contour, said inner portion complementary contour includes at least one feature selected from a group consisting of means for retaining the product and at least one window for displaying the product; and providing the retaining means with at least one orifice through which the product is disposed, providing the at least one orifice with a geometric shape, providing the geometric shape with at least one digit the at least one digit forms a valve for facilitating retention of the product; and the at least one digit includes five digits, the five digits form a pentagram configuration.

9. A method, as recited in claim 8, the product includes an audio interconnect cable having at least one connector correspondingly disposed on at least one end of the cable, and the inner portion providing step includes threading the at least one connector through the at least one orifice and retaining the cable is by the valve.

10. A method, as recited in claim 8, the inner portion providing step includes providing the inner portion complementary contour with a rounded recess for facilitating coiling of the cable, and the front portion providing step includes providing the front portion complementary contour with a rounded recess for accommodating the inner portion complementary contour rounded recess.

11. A method, as recited in claim 8, including providing means for fastening the front portion to the back portion.

12. A method, as recited in claim 11, the front portion providing step includes providing the front portion with an outer dimension, providing at least one coincident tap distributed along a periphery, and providing a coincident orifice for facilitating display of the product by hanging, the back portion providing step includes providing the back portion with an outer dimension being approximately equal to that of the front portion outer dimension, providing at least one coincident tap distributed along a periphery, providing a coincident orifice for facilitating display of the product by hanging, the inner portion providing step includes providing the inner portion with an outer dimension less than that of both the front portion and that of the back portion, and the fastening means providing step includes providing at least one rivet disposed through the corresponding coincident taps for sandwiching the inner portion, accommodating the product, between the front portion and the back portion.

13. A method, as recited in claim 8, further including providing a liner insert being disposed between the front portion and the inner portion as well as between the back portion and the inner portion, the liner insert facilitating advertisement and identification of the product, the front, inner, and back portions all include a material having an optical property selected from a group consisting of transparency and translucency for facilitating viewing of the liner insert and the product.

14. A method of packaging, displaying and storing a product, including the steps of:

providing a front portion including a complementary contour;

providing a back portion including a complementary contour; and providing an inner portion including a complementary contour, the inner portion being disposed between the front portion and the back portion, and the front portion, the back portion, and the inner portion being fitted together via their respective complementary contours;

said inner portion providing step includes accommodating the product in the inner portion complementary contour, providing the inner portion complementary contour with at least one feature selected from a group consisting of means for retaining the product and at least one window for displaying the product, providing the retaining means with at least one orifice through which the product is disposed, providing the at least one orifice with a geometric shape, and providing the geometric shape with at least one digit, the at least one digit forms a valve for facilitating retention of the product, forming the at least one digit as five digits, the five digits form a pentagram configuration, said product includes an audio interconnect cable having at least one connector correspondingly disposed on at least one end of the cable, retaining the at least one connector by the valve, providing the inner portion complementary contour with a rounded recess for facilitating coiling of the cable, and providing the front portion complementary contour with rounded recess for accommodating the inner portion complementary contour rounded recess.

* * * * *